US007430782B2

(12) United States Patent
Ruffo

(10) Patent No.: US 7,430,782 B2
(45) Date of Patent: Oct. 7, 2008

(54) FLOOR CLEANING MACHINE, PARTICULARLY FOR INDUSTRIAL APPLICATIONS

(75) Inventor: Massimiliano Ruffo, Verona (IT)

(73) Assignee: Comac S.p.A., San Giovanni Lupatoto (IT)

( * ) Notice: Subject to any disclaimer, the term of this patent is extended or adjusted under 35 U.S.C. 154(b) by 73 days.

(21) Appl. No.: 11/062,555

(22) Filed: Feb. 23, 2005

(65) Prior Publication Data

US 2005/0251948 A1 Nov. 17, 2005

(30) Foreign Application Priority Data

May 11, 2004 (IT) ..... VR2004U0018

(51) Int. Cl.
*A47L 5/00* (2006.01)

(52) U.S. Cl. ..... 15/300.1; 15/340.1; 15/412; 15/DIG. 1

(58) Field of Classification Search ..... None
See application file for complete search history.

(56) References Cited

U.S. PATENT DOCUMENTS 3,837,028 A 9/1974 Bridge
5,360,307 A 11/1994 Schemm et al.
5,890,258 A 4/1999 Lee et al.
6,397,429 B1 6/2002 Legatt et al.

FOREIGN PATENT DOCUMENTS

WO WO 97/49528 A 12/1997

OTHER PUBLICATIONS

Patent Abstracts of Japan vol. 1997, No. 02, Feb. 28, 1997 & JP 08 252203 A (Matsushita Electric Ind Co Ltd), Oct. 1, 1996 * abstract * .

*Primary Examiner*—David A Redding
(74) *Attorney, Agent, or Firm*—Modiano & Associati; Albert Josif; Daniel J. O'Byrne

(57) ABSTRACT

A floor cleaning machine particularly for industrial applications, comprising a box-like structure, which is provided, in its downward region directed toward the floor, with floor cleaning devices, and supports electrical controls for actuating and controlling the machine, at least one part of the electrical controls for actuating and controlling the machine being associated with a supporting body that can be detachably coupled to the box-like structure, and connectors for detachable electrical connection being provided between the part of the controls for actuation and control and their remaining part.

5 Claims, 2 Drawing Sheets

FLOOR CLEANING MACHINE, PARTICULARLY FOR INDUSTRIAL APPLICATIONS

The present invention relates to a floor cleaning machine, particularly adapted for use in the industrial field.

BACKGROUND OF THE INVENTION

Floor cleaning machines, particularly for industrial applications, commonly known as "floor cleaners", are known which are generally constituted by a box-like structure, which is optionally provided with motorized driving wheels and has, in its lower part directed toward the floor, a nozzle that dispenses a washing liquid and is directed toward the floor, one or more rotating brushes, which generally have a vertical axis, and, behind the brushes and the nozzle with respect to the travel direction of the machine, a suction intake and a floor wiper for collecting the dispensed liquid and the removed dirt.

Currently, floor cleaning machines have an electrical part that is completely enclosed in their box-like structure. For example, the electrical part of these machines is substantially constituted by the electronic boards for controlling the motors that drive the brushes or the driving wheels, by the battery control board, by the fuses, by the remote control switches, by the relays and by the electrical cables for connecting the various components and by the cables for connection to the utility switches.

As can be noticed, the electrical part is rather complicated with respect to the relative constructive simplicity of the machine, and therefore failures in the electrical part are not infrequent, and force, because of the laborious nature of the operations for replacing and repairing the failed components (also in view of the fact that access to the inside of the box-like body is often not easy without having to disassemble it in some way), long machine downtimes, which are poorly tolerated by the users of the machine, as is clearly understandable.

SUMMARY OF THE INVENTION

The aim of the present invention is to provide a new and advantageous solution to the problem described above by providing a floor cleaning machine, particularly for industrial applications, which in case of faults of the electrical part allows to restore correct functionality of the machine in an extremely short time regardless of the type of fault that has occurred and of the time required to repair it.

Within this aim, an object of the present invention is to provide a machine that thanks to its particular constructive characteristics allows maintenance and replacement of components of electrical part to become very easy to perform.

Another object of the present invention is to provide a machine that has a very simple structure and a competitive production cost.

This aim and these and other objects that will become better apparent hereinafter are achieved by a floor cleaning machine particularly for industrial applications according to the invention, comprising a box-like structure, which is provided, in its downward region directed toward the floor, with floor cleaning means, and supports electrical means for actuating and controlling the machine, characterized in that at least one part of said electrical means for actuating and controlling the machine is associated with a supporting body that can be detachably coupled to said box-like structure, means being provided for detachable electrical connection between at least one part of said actuation and control means and their remaining part.

BRIEF DESCRIPTION OF THE DRAWINGS

Further characteristics and advantages of the invention will become better apparent from the description of a preferred but not exclusive embodiment of the machine according to the invention, illustrated by way of non-limiting example in the accompanying drawings, wherein.

DESCRIPTION OF THE PREFERRED EMBODIMENTS

Figure 1:
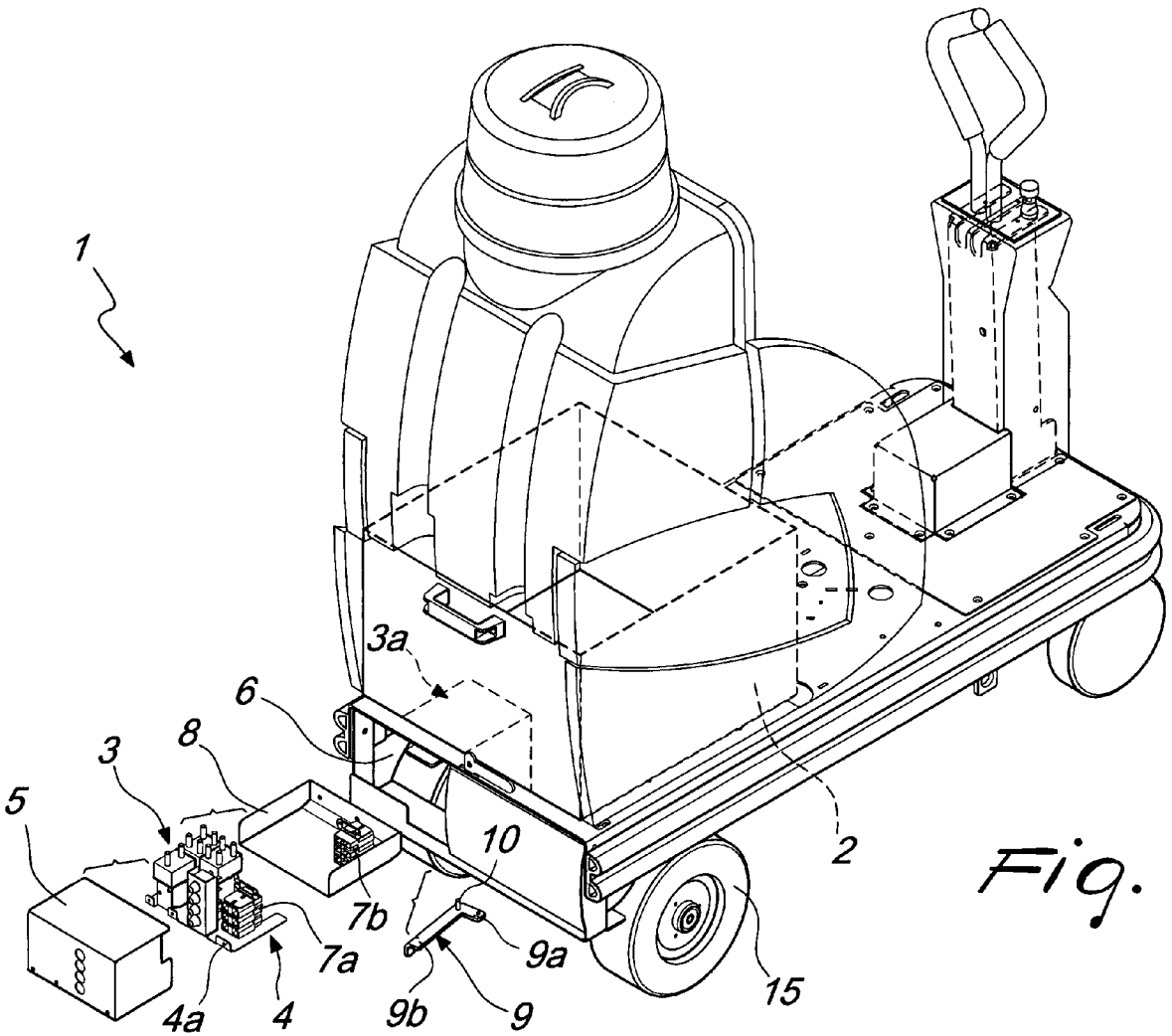
FIG. 1 is a schematic exploded view of the machine according to the invention, with parts shown in phantom lines for the sake of greater clarity.
Figure 2:
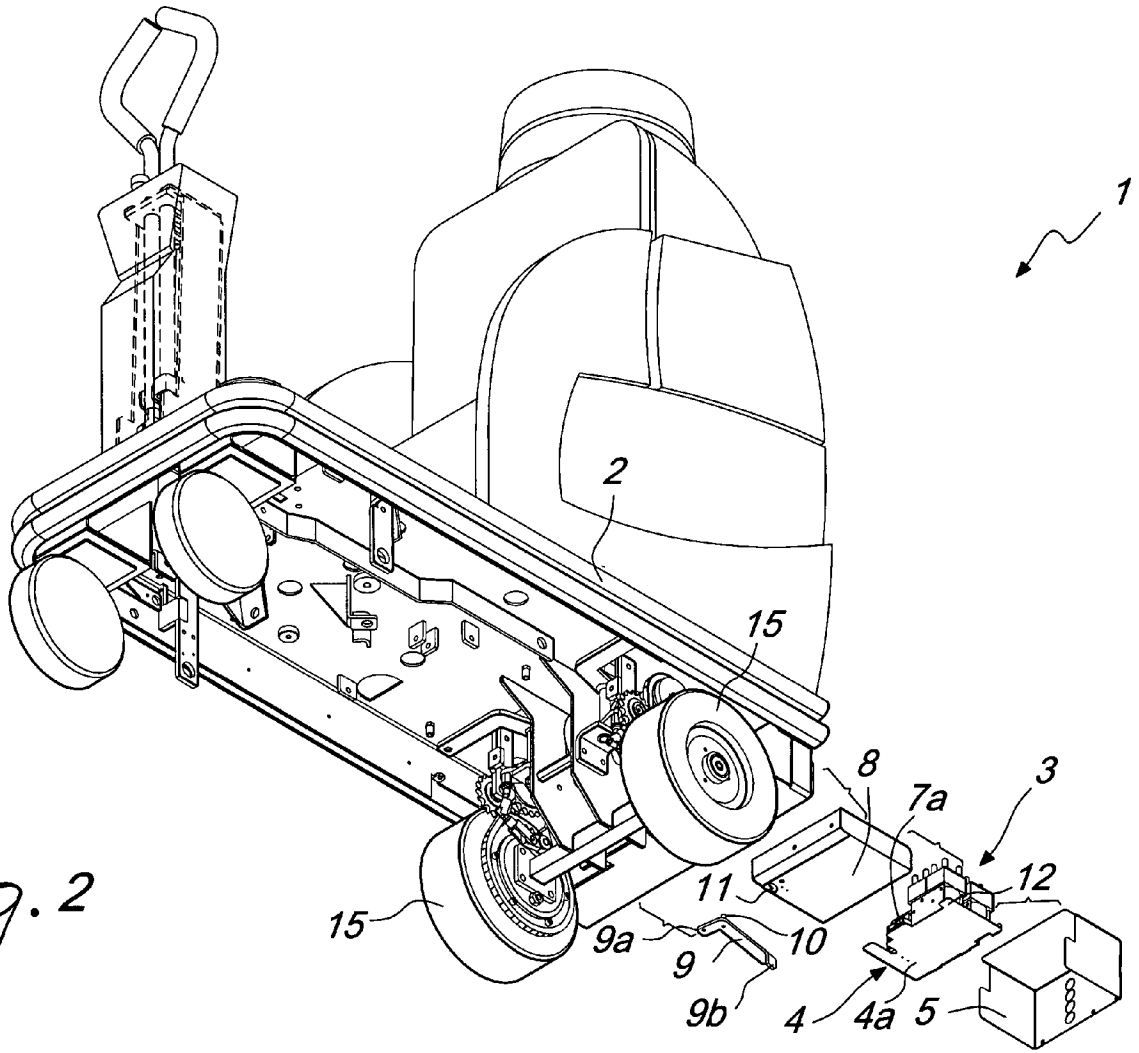
FIG. 2 is a highly schematic exploded perspective view of the machine according to the invention, taken from below.

In the examples of embodiments that follow, individual characteristics, given in relation to specific examples, may actually be interchanged with other different characteristics that exist in other examples of embodiments.

Moreover, it is noted that anything found to be already known during the patenting process is understood not to be claimed and to be the subject of a disclaimer.

With reference to the figures, the floor cleaning machine, particularly for industrial applications, according to the invention, generally designated by the reference numeral 1, comprises a box-like structure 2, which supports, in its lower region directed toward the floor, floor cleaning means (such as described in a copending patent application by the same Applicant), which comprise, for example, a nozzle for dispensing a jet of detergent liquid, one or more rotating brushes and a suction intake, which in cooperation with a floor wiper arranged to the rear with respect to the travel direction of the machine is designed to collect the washing liquid and the dirt removed by the brushes.

The box-like structure 2 generally accommodates a known type of suction device, which can be connected to the suction intake, a motor for rotary actuation of the brushes, and an actuation motor for any driving wheels 15 of the machine, both of which are per se known, and means for delivering the washing liquid, which are also of a per se known type and can be connected to the dispensing nozzle.

Moreover, the box-like structure 2 supports electrical means 3 for actuation and control of the machine, which substantially constitute the so-called electrical part of the machine and also comprise, in addition to the battery, the utility switches, remote control switches, relays, electronic control boards, electrical connection cables and so forth.

The particular characteristic of the machine consists in that at least one part 3 of the electrical means for machine control and actuation is associated with a supporting body 4, which can be detachably coupled to the box-like structure 2.

Said supporting body 4 is advantageously provided in a plurality of parts, which are detachably coupled one another by interlocking or in another equivalent manner, in order to allow their quick assembly or disassembly, and comprise for example a plate-like supporting base 4*a* and a protective enclosure 5.

Preferably but not necessarily, the part 3 of the machine control and actuation means that is associated with the supporting body 4 is constituted by the remote control switches, fuses, driving control chopper board, electronic battery control board, and relays.

Means for detachable electrical connection between the part 3 and the remaining part 3*a* of the actuation and control means are also provided; said remaining part is instead supported or accommodated directly in the box-like structure 2 as schematically shown in FIG. 1 and comprises for example the utility switches, the power supply battery or batteries, and the corresponding interconnection cables and the cables for connection to the part 3.

Conveniently, the box-like structure 2 forms a compartment 6, which is open toward, and can be accessed from outside and is designed to accommodate internally the supporting body 4.

Advantageously, means for detachable coupling of the supporting body 4 to the box-like structure 2 and means for deactivating said detachable coupling means are provided.

In particular, said detachable electrical connection means conveniently comprise a first known type of electrical connector 7*a*, which is electrically connected to the part 3 of the electrical actuation and control means CM of the machine and is associated with the supporting body 4, and a second electrical connector 7*b*, also of a known type, which is connected to the remaining part 3*a* of the electrical control and actuation means of the machine (for example by means of appropriate cables) and is rigidly associated with the box-like structure 2 and more preferably with a wall element 8, which delimits the compartment 4 internally and can be for example fixed to the supporting structure 2 by screws or the like, so that it can be optionally disengaged from the supporting structure 2. The first electrical connector 7*a* and the second electrical connector 7*b* can be detachably coupled to each other in order to provide the electrical connection between the part 3 of the electrical actuation and control means that is associated with the supporting body 4 and their remaining part, which is supported by the box-like structure 2.

Advantageously, the means 12 for detachable coupling of the supporting body 4 to the box-like structure 2 are constituted by snap-acting quick-coupling means, which allow to connect the first electrical connector to the second electrical connector and are of a per se known type commonly provided in normal commercially available electrical connectors.

Conveniently, the means for deactivating the detachable coupling means comprise a lever 9, which is for example L-shaped and is pivoted, at one of its ends 9*a*, to the box-like structure 2 and more particularly to the wall 8 externally with respect to the compartment 6. The lever 9 has an actuation end 9*b*, which can be accessed from the outer side of the box-like structure 2, and an intermediate active portion, which supports a pivot 10 that passes through a through slot 11, which is formed in the wall 8 and has a circular arc-like shape centered in the fulcrum of the lever 9.

The pivot 10 is designed to push the supporting body 4 following a rotation of the lever 9 about its fulcrum in order to move the supporting body 4 away from the box-like structure 2 so as to release the snap-acting quick-coupling means, with consequent disengagement of the first electrical connector 7*a* from the second electrical connector 7*b*.

The use of the machine according to the invention is evident from what has been described above and in particular, in case of a fault affecting one or more of the components of the part 3 of the electrical means for control and actuation of the machine that are associated with the supporting body 4, the user can separate (for example by operating the lever 9) from the box-like structure 2 the block constituted by the part 3 and by the supporting body 4, in order to send it to be repaired, and in practice can replace it immediately with a backup one available for use and thus resume operation of the machine without having to wait for the faulty component or components to be replaced or repaired. It should be noted that in order to connect the part 3 to the remaining part of the electrical control and actuation means it is sufficient to simply-slide the supporting body 3 within the compartment 6 until the snap-acting quick-coupling means engage, with consequent engagement of the first electrical connector 7*a* with the second electrical connector 7*b*.

All the characteristics of the invention described above as advantageous, convenient or the like may also be omitted or be replaced with equivalents.

The individual characteristics described with reference to general teachings or particular embodiments may all be present in other embodiments or may replace characteristics in said other embodiments.

The invention thus conceived is susceptible of numerous modifications and variations, all of which are within the scope of the appended claims.

In practice, the materials used, as well as the contingent shapes and dimensions, may be any according to requirements.

All the details may further be replaced with other technically equivalent elements.

The disclosures in Italian Utility Model Application No. VR2004U000018 from which this application claims priority are incorporated herein by reference.

What is claimed is:

1. A floor cleaning machine for industrial applications, comprising:

a box-like structure;

floor cleaning means provided, in a downward region of the box-like structure, directed in use toward a floor;

electrical components for actuating and controlling the machine, said electrical components comprising a first portion of electrical components including an electronic control board, remote control switches, fuses, and relays, and said electrical components comprising a second portion of electrical components comprising a battery;

a supporting body that is detachably couplable to said box-like structure, said supporting body supporting said first portion of said electrical components for actuating and controlling the machine, and said battery of said second portion of said electrical components for actuating and controlling the machine being supported directly by said box-like structure; and a detachable electrical connector for detachable electrical connection between said first portion of said electrical components and said second portion of said electrical components including said battery.

2. The machine of claim 1, wherein said second portion of electrical components further comprise utility switches that are supported directly by said box-like structure.

3. The machine of claim 1, wherein said box-like structure forms a compartment that is provided with a side that is open toward an outside region of the box-like structure, said compartment being adapted to accommodate said supporting body.

4. The machine of claim 2, wherein said detachable electrical connector comprise:

a first electrical connector, which is connected electrically to said first portion of said electrical components and is associated with said supporting body; and a second electrical connector, which is connected to said second portion of said electrical components and is associated with said box-like structure, said first electrical connector and said second electrical connector being associable detachably in order to provide electrical connection between said first portion of said electrical components and said said second portion of said electrical components.

5. The machine of claim 4, further comprising a quickly snap-acting coupling of said first electrical connector to said second electrical connector, a lever that is pivoted to said box-like structure and has an actuation end that is accessable from an outer side of said box-like structure, and said lever having an active portion that is adapted to act on said supporting body so as to move the supporting body away from said box-like structure in order to disengage said first electrical connector with respect to said second electrical connector.

* * * * *